US006024597A

United States Patent [19]

Lok

[11] Patent Number: 6,024,597

[45] Date of Patent: Feb. 15, 2000

[54] CABLE CONNECTOR ASSEMBLY WITH A SHUNTING BAR FOR SHORT-CIRCUITING

[75] Inventor: Gordon Lok, Montebell, Calif.

[73] Assignee: Hon Hai Precision Ind. Co., Ltd., Taipei Hsien, Taiwan

[21] Appl. No.: 08/979,046

[22] Filed: Nov. 26, 1997

[51] Int. Cl.[7] ..... H01R 9/07

[52] U.S. Cl. ..... 439/497; 439/402

[58] Field of Search ..... 439/189, 402, 439/49, 404, 405, 455, 497

[56] References Cited

U.S. PATENT DOCUMENTS

| | | | |
|---|---|---|---|
| 4,487,464 | 12/1984 | Kirschenbaum | 439/62 |
| 4,641,904 | 2/1987 | Kosugi | 439/404 |
| 4,820,192 | 4/1989 | Denkmann | 439/404 |
| 4,990,103 | 2/1991 | Sazaki | 439/455 |
| 5,041,011 | 8/1991 | Chiang | 439/405 |
| 5,593,315 | 1/1997 | Kinoshita | 439/404 |
| 5,755,598 | 5/1998 | Taylor | 439/404 |
| 5,836,774 | 11/1998 | Tan | 439/189 |

*Primary Examiner*—Neil Abrams
*Assistant Examiner*—Javaid Nasri

[57] ABSTRACT

An electrical cable connector assembly (10) includes an insulator (16) defining a plurality of receiving passageways (18, 20) therein for receiving a corresponding number of contacts (22, 24) therein wherein each contact has an IDC termination end (40) for engagement with the corresponding wire (46). A shunting device (60) includes a unitary body with fork-like piercing lances (68) thereon for engagement with the selective contacts. A pair of spacers (48, 50) are disposed on the upper and lower surfaces (21, 23) of the insulator (16) to providing a plurality of troughs (52) for receiving the corresponding wires (46) therein. A pair of metal shields (82, 84) are attached to the exterior of the spacers (48, 50). A pair of covers (90, 91) are respectively positioned on the exterior of the corresponding metal shields (82, 84) for protection and fastening the internal parts therein. A front shell (76) and an associated attachment housing (70) are fastened to a front portion of the insulator (16) for defining a mating end of the connector assembly (10). A strain relief (102) is assembled to the rear end of the covers (90, 91) for preventing improper undesired impact upon connection between the wires (46) and the corresponding contacts (22, 24), due to pulling force applied on the cable.

10 Claims, 8 Drawing Sheets

CABLE CONNECTOR ASSEMBLY WITH A SHUNTING BAR FOR SHORT-CIRCUITING

BACKGROUND OF THE INVENTION

1. Field of the Invention

The invention relates to connector assembly, and particularly to the cable connector assembly using IDC (Insulative Displacement Contact) means for cooperation with an IDC like shunting bar for selectively connecting or shorting at least one set of specific contacts together.

2. The Related Art

Most I/O (Input/Output) cable connectors which, are generally different from the so-called flat cable connectors used on the interior of the computer, are used among the peripheries and computer, for example, U.S. Pat. No. 5,505,637. As well known, the cable connector contains a bunch of wires in the jacket of the cable and such I/O cable connector uses the traditional solder method to respectively solder the contacts to the corresponding wires. This soldering procedure takes time and labor, and costs money. Moreover, because the adjacent contacts are positioned close to each other, the solder may contaminate the adjacent contact/wire, thus resulting in the solder bridge between two adjacent contacts/wires and the corresponding undesired and incorrect shorting circuits therebetween. Oppositely, sometimes some far spaced specific contacts/wires should be grouped as one set by shorting together for meeting some required designed circumstances, that requires to intentionally short such contacts/wires together by soldering of the so-called jumper wires connected between every two of the selective contacts/wires. It also takes time and labor, and naturally costs money. For references, some U.S. patents, which are not of the same application field as the invention but with the same theory, disclose several different type shunt or jumper device incorporating some different type connectors for replacement of the complementary connectors during non-mating period of the subject connectors, for example, U.S. Pat. Nos. 4,602,834, 4,607,899, 4,997,390, 5,000,699, 5,391,096 and 5,609,493, Therefore, an object of the invention is to provide a cable connector assembly having a bunch of wires connected thereof, wherein the contacts of the connector are connected to the corresponding wires through IDC means and a unitary shunting bar having piercing means thereon cooperating with the selective wires thereabouts, so that the contacts of connector can be electrically connected to the corresponding wires through such IDC means and some designated contacts can be short-circuiting with one another through such piercing means.

SUMMARY OF THE INVENTION

According to an aspect of the invention, an electrical cable connector assembly includes an insulator defining a plurality of receiving passageways therein for receiving a corresponding number of contacts therein wherein each contact has an IDC termination end for engagement with the corresponding wire. A shunting device includes a unitary body with fork-like piercing lances thereon for engagement with the selective contacts. A pair of spacers are disposed on the upper and lower surfaces of the insulator to providing a plurality of troughs for receiving the corresponding wires therein. A pair of metal shields are attached to the exterior of the spacers. A pair of covers are respectively positioned on the exterior of the corresponding metal shields for protection and fastening the internal parts therein. A front shell and an associated attachment housing are fastened to a front portion of the insulator for defining a mating end of the connector assembly. A strain relief is assembled to the rear end of the covers for preventing improper undesired impact upon connection between the wires and the corresponding contacts, due to pulling force applied on the cable.

DETAILED DESCRIPTION OF THE PREFERRED EMBODIMENTS

References will now be in detail to the preferred embodiments of the invention. While the present invention has been described in with reference to the specific embodiments, the description is illustrative of the invention and is not to be construed as limiting the invention. Various modifications to the present invention can be made to the preferred embodiments by those skilled in the art without departing from the true spirit and scope of the invention as defined by appended claims.

Figure 1:
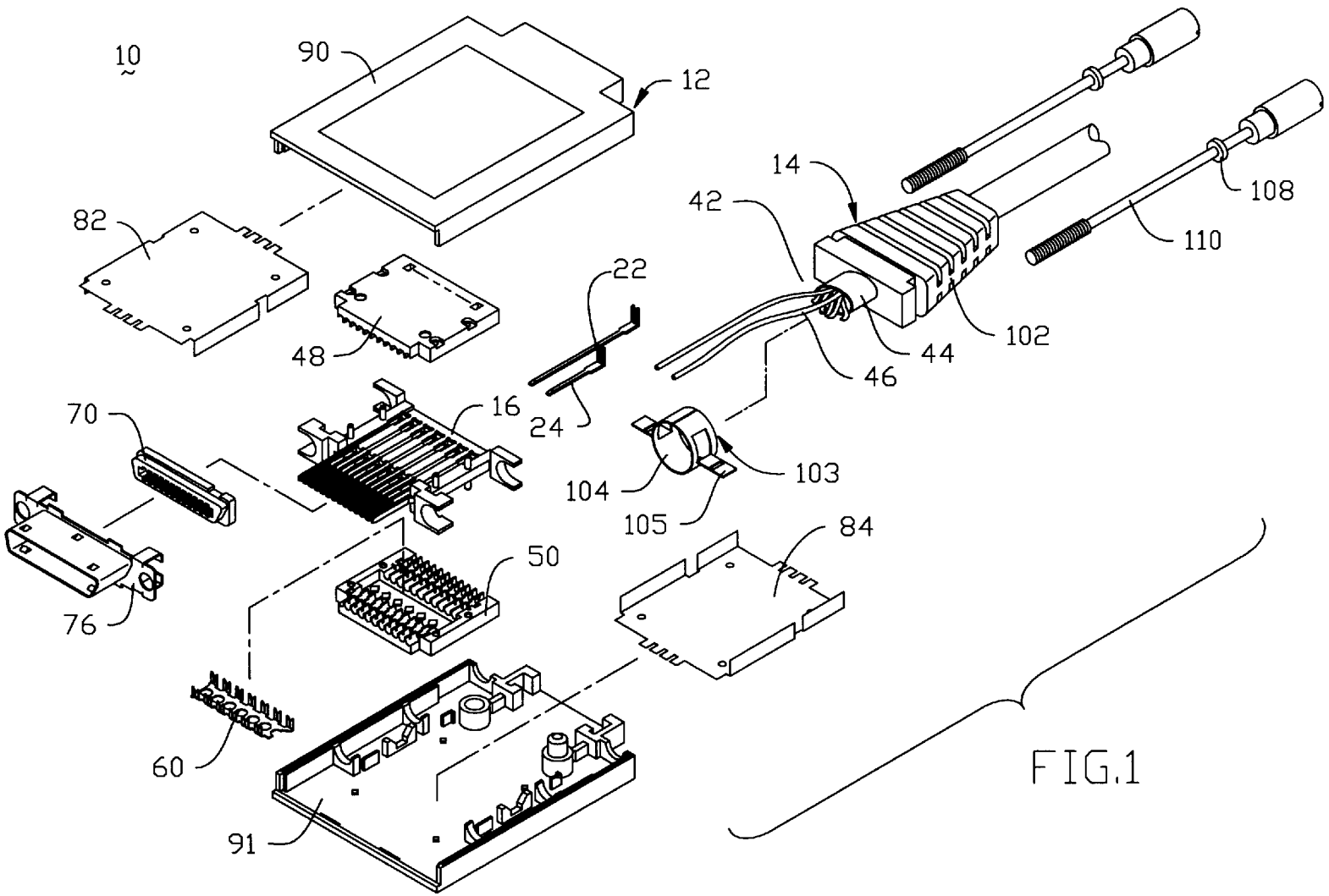
FIG. 1 is an exploded perspective view of a presently preferred embodiment of a cable connector assembly, according to the invention
Figure 2:
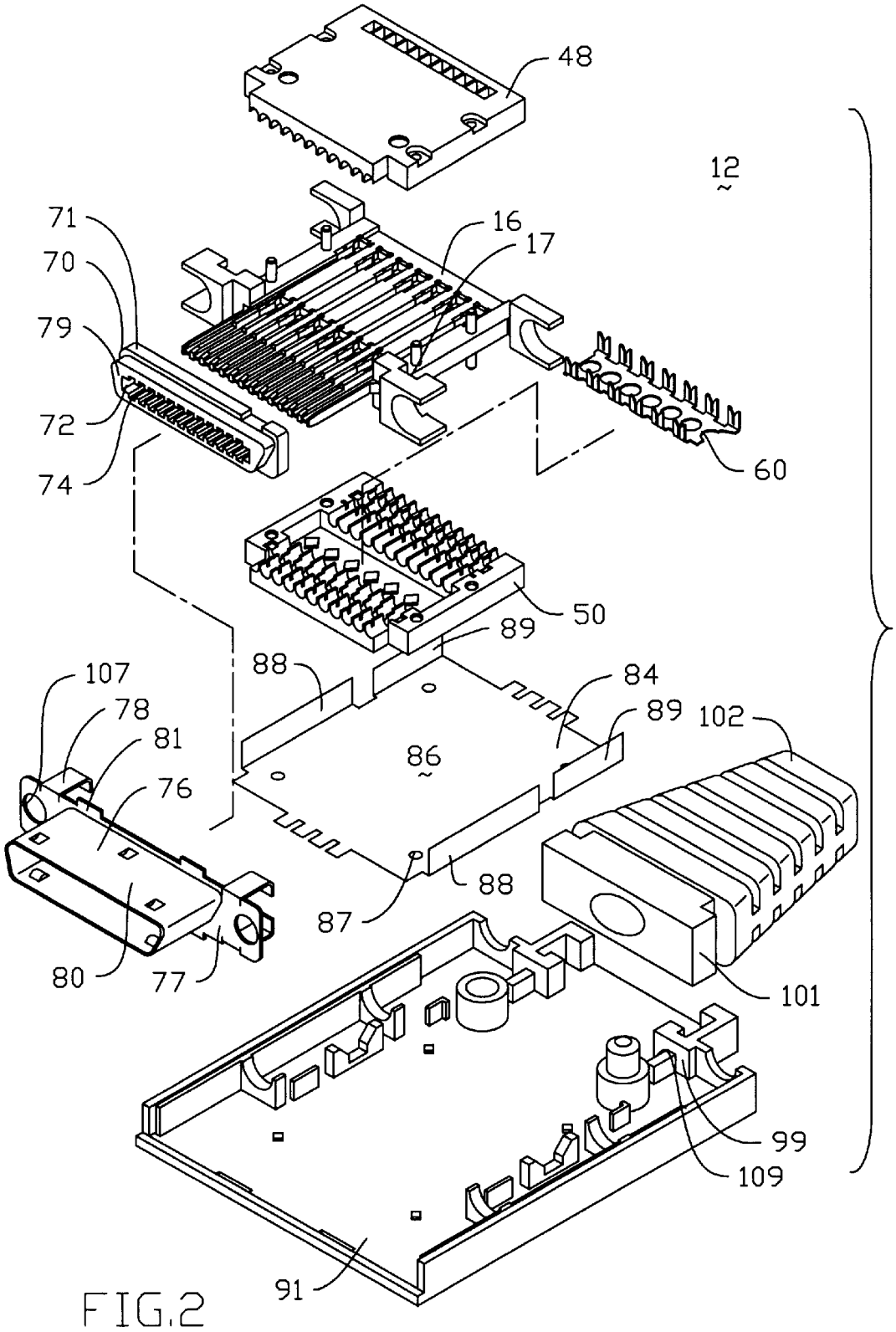
FIG. 2 is an enlarged exploded perspective view of the cable connector assembly of FIG. 1 without showing the top metal shield, the top cover, the securing clip, and the corresponding cable/wires, to show remaining components of the whole assembly for easy illustration.
Figure 3:
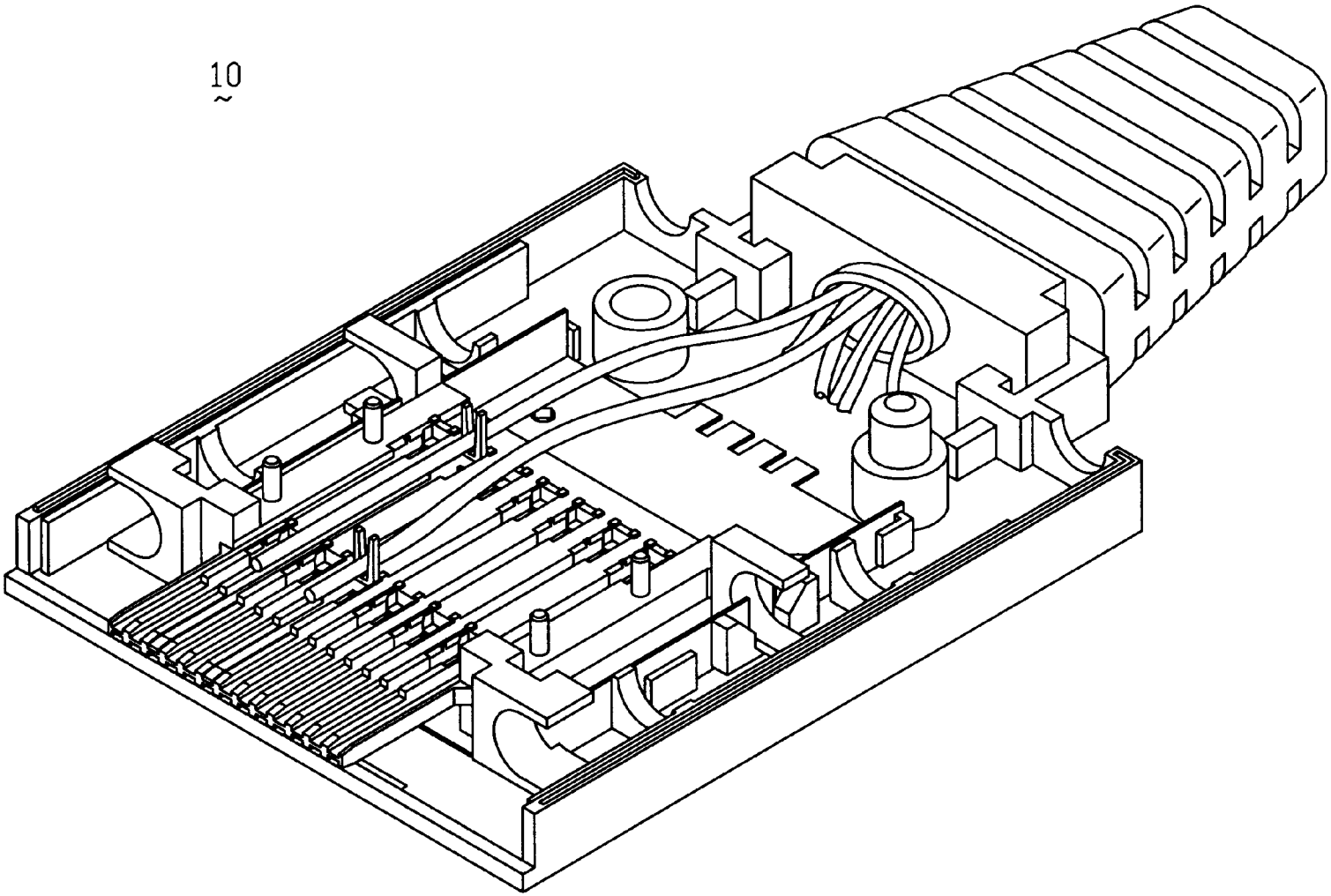
FIG. 3 is an enlarged perspective view of the partially assembled cable connector assembly of FIG. 1 to show how the interior parts embedded within the internal space defined between the top cover and the bottom cover.
Figure 4:
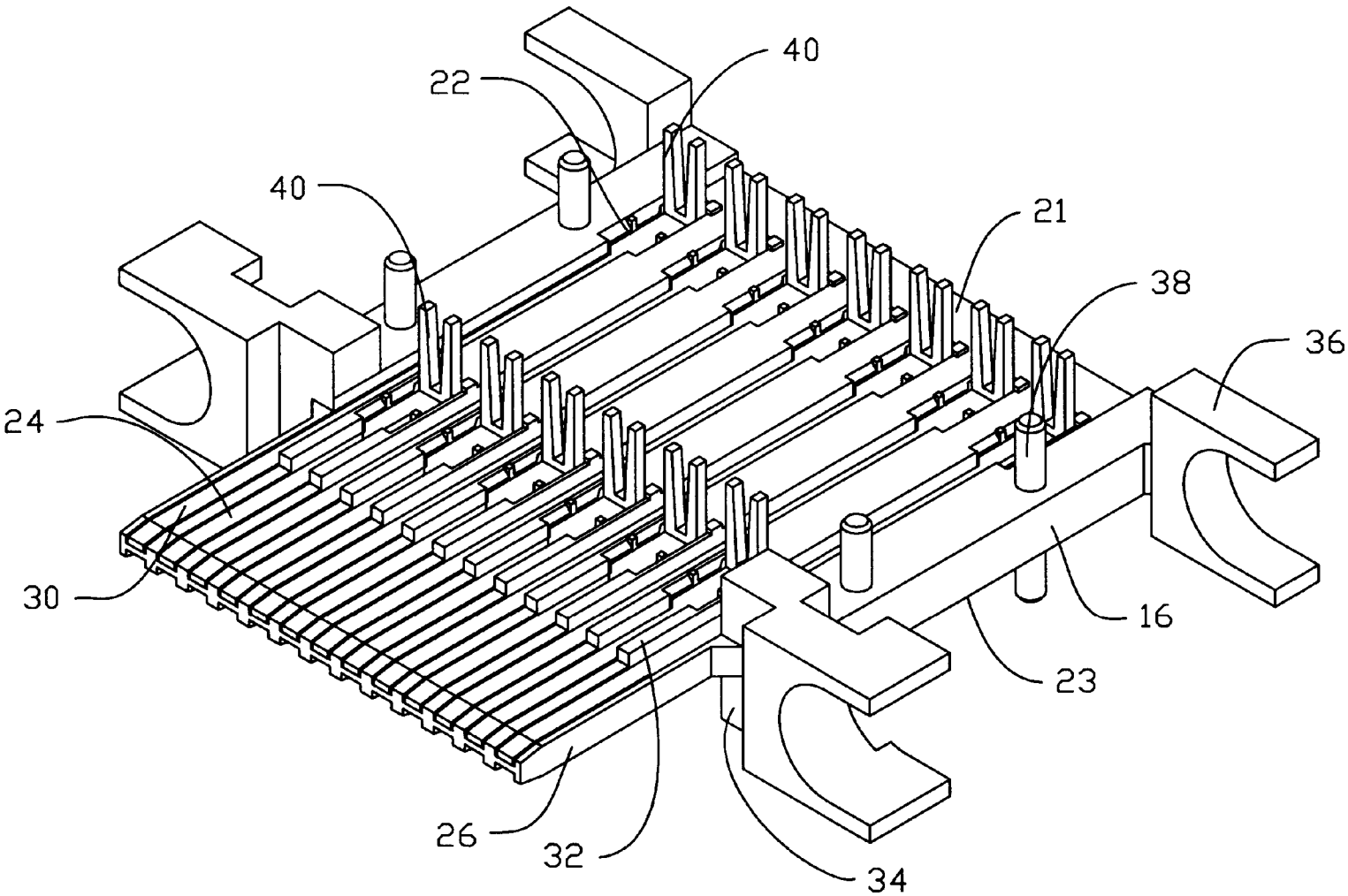
FIG. 4 is an enlarged perspective view of the partially assembled cable connector assemble of FIG. 1 to show how the contacts are disposed in th e insulator.
Figure 5:
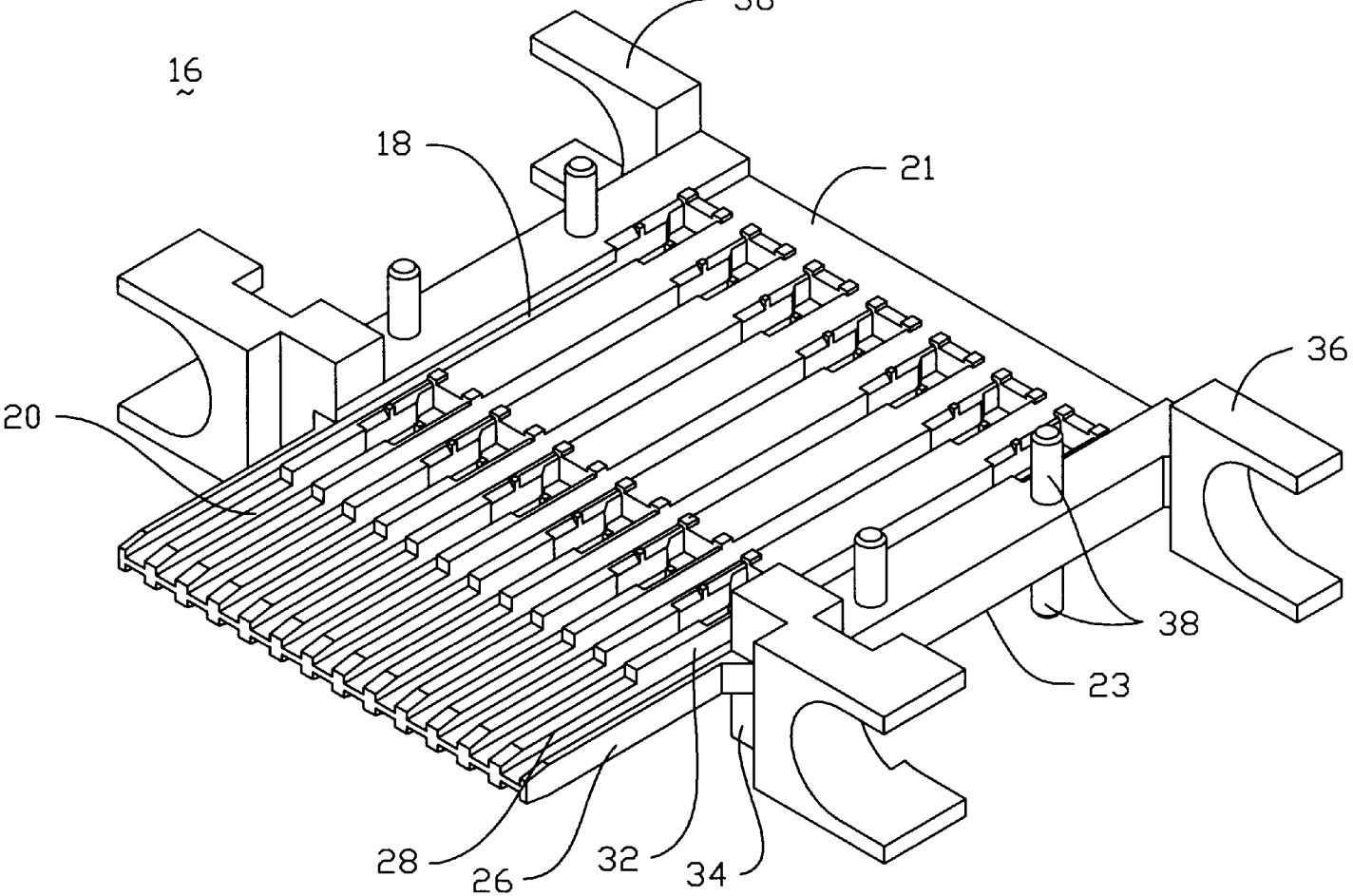
FIG. 5 is an enlarged perspective view of the insulator of the cable connector assembly of FIG. 1 to show the structure thereof.

It will be noted here that for a better understanding, most of like components are designated by like reference numerals throughout the various figures in the embodiments. Attention is directed to FIGS. 1–3 wherein an electrical cable/plug connector assembly 10 includes a connector section 12 and a cable section 14. The connector section includes an insulator 16 (also referring to FIG. 5) defining a plurality of long passageways 18 and a plurality of short passageways 20 alternatively extending in a front-to-end direction on both the top surface 21 and the bottom surface 23 (only the ones of the top surface 21 shown). Also referring FIG. 4, a corresponding number of long contacts 22 and another corresponding number of short contacts 24 are respectively received within the corresponding long and short passageways 18, 20. An blade section 26 is formed on the front portion of the insulator 16 wherein the front portions 28 of the passageways 18, 20 are positioned therein so that the engagement sections 30 of the contacts 22, 24 are received within said front portions 28 of the passageways 18, 20. The blade section 26 further includes a plurality of parallel spaced engagement projections 32 on both the top and bottom surface 21, 23 for engagement with the corresponding notch 72 of the housing 70, that will be described later.

To receive the housing 70, the insulator 16 includes a recess 34 at the front end thereof. Moreover, to cooperate with two screws 110, two pairs of mounting ears 36 are provided on two sides thereof wherein each pair of mounting ears 36 are respectively positioned on two sides of the insulator 12. Two pairs of alignment posts 38 extending vertically on two sides of each of the top surface 21 and of the bottom surface 23 for incorporating the alignment holes 64 of the corresponding spacer 48, 50, that will be described later.

Each of the contacts 22, 24 has the engagement section 30 on the front portion and a termination section 40 on the end portion, wherein the engagement section 30 is adapted to be engaged with the corresponding contact section of the complementary receptacle connector (not shown), and the termination section 40 is adapted to be engaged with the corresponding wire 46 of the cable 42, that will be described later. Each of the contact 22, 24 further includes a barb-like retention section (not shown) which can retain the contact 22, 24 in the corresponding passageways 18, 20 in an interference fit.

The cable 42 includes a jacket 44 enclosing a plurality of wires 46 therein wherein each wire 46 is mechanically and electrically engaged with the termination section 40 of the corresponding contact 22, 24 via IDC connection. It should be understood that although FIGS. 1 and 3 only show two wires 46 cooperating with the corresponding long contact 22 and short contact 24 on the top surface 21 of the insulator 16, the remaining wires 46 and the corresponding contacts 22, 24 also have the same relationship with each other.

Figure 8:
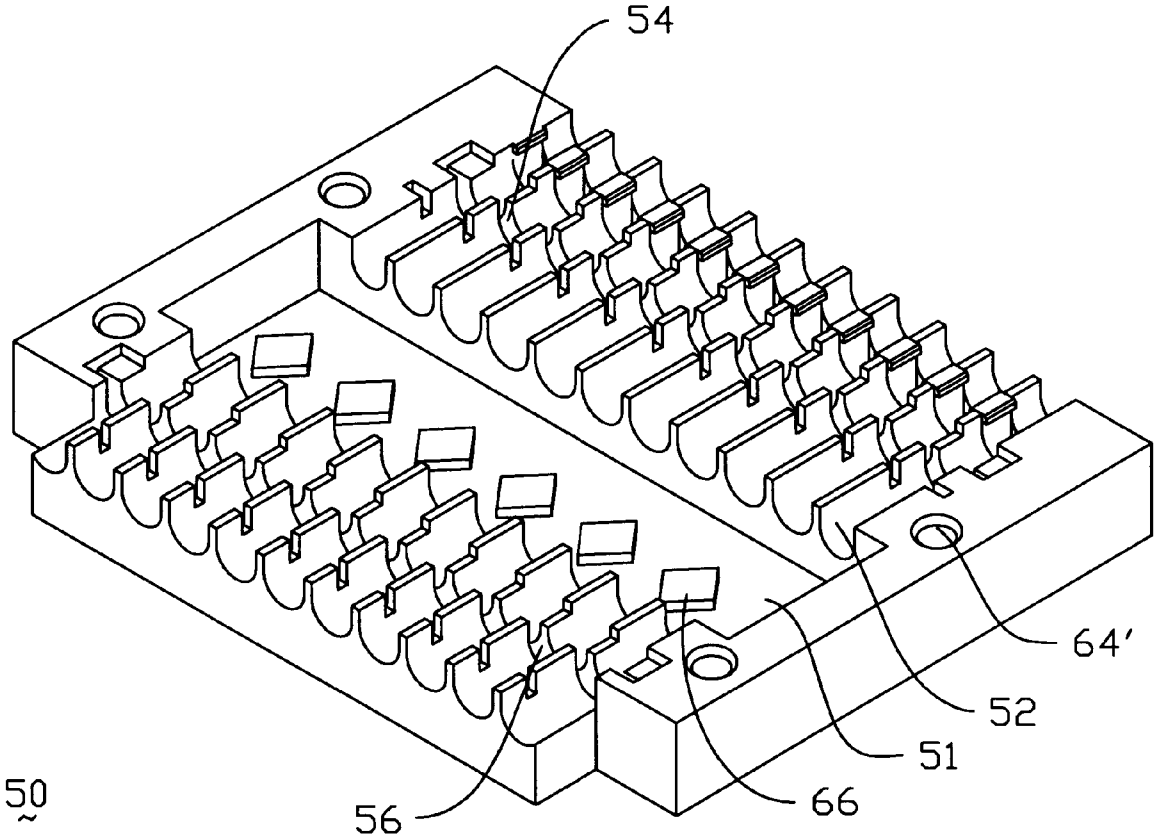
FIG. 8 is an enlarged perspective view of the bottom spacer of the cable connector assembly of FIG. 1.

Also referring to FIG. 8, a top spacer 48 and a bottom spacer 50 are respectively disposed on the top surface 21 and the bottom surface 23 of the insulator 16 wherein each spacer 48, 50 includes a plurality of receiving troughs 52 corresponding to and in vertical alignment with the corresponding passageways 18, 20, whereby each wire 46 which is engagably pierced by the termination section 40 of the corresponding contact 22, (24) and is adapted to be received within the corresponding trough 52. Each of the spacer 48, 50 has a pair of elongated slit 54, 56 extending transversely on the front portion and the rear portion thereof for properly receiving the fork-like termination sections 40 of the contacts 22, 24.

Figure 7:
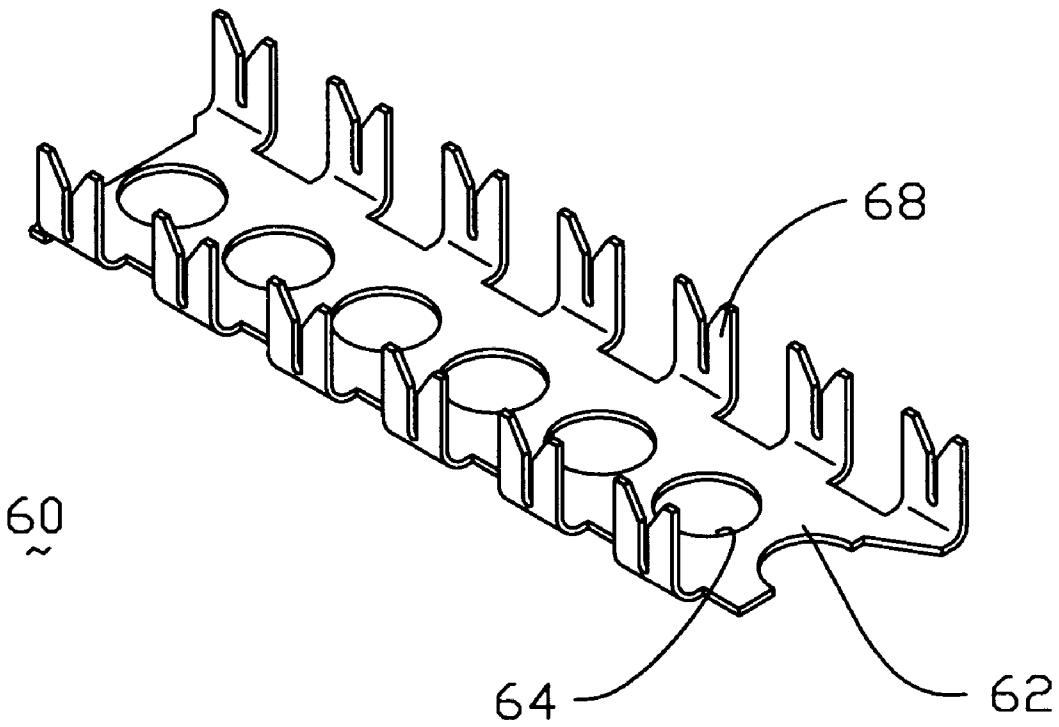
FIG. 7 is an enlarged perspective view of the shunting bar of the cable connector assembly of FIG. 1.

One feature of the invention is that the bottom spacer 50 further includes a cavity 51, and a shunting bar 60 (FIG. 7) is received therein. The shunting bar 60 includes a base plate 62 with mounting openings 64 therein for cooperation with the mounting posts 66 extending upward from the bottom spacer 50 in the cavity 51 so that the shunting bar 60 can be retainably received within the cavity 51. The shunting bar 60 further includes a plurality of detachable fork-like piercing lances 68 for selectively mechanical and electrical engagement with the designated wires 46. In other words, some piercing lances 68 of the shunting bar 60 can be detached from the base plate 62 thereof for not mechanical and electrical engagement with the non-designated wires 46, while the remaining piercing lances 68 may interconnect with the corresponding designated wires 46, respectively, in an IDC state, thereby resulting in shorting-circuit function of such designated wires 46.

To align the spacer 48, 50 with the insulator 16 during assembling, the spacer 48, 50 includes alignment holes 64 for receivable engagement with the alignment posts 38 of the insulator 16.

The housing 70 is assembled to the insulator 16 by means that the housing 70 is generally received within the recess 34 of the insulator 16, whereby the engagement projections 32 of the insulator 16 may be receivably engaged within the notches 72 of the housing 70, respectively. At the same time, each of the abutment projections 74, formed between every adjacent two notches 72, of the housing 70 may press against the corresponding contact 22, 24 for providing an additional retention other than the aforementioned barb-like retention section of the contact 22, 24.

A shell 76 is fastened to the insulator 16 by means that the hooks 78 are retainably engaged within the indents 17 of the insulator 16, whereby the housing 70 may be sandwiched between the shell 76 and the insulator 16 and securely received within the recess 34 in the insulator 16 through abutment between the vertical plate 71 of the housing 70 and the vertical plate 77 of the shell 76. Under this situation, the D-shaped forward extension 79 of the housing 70 can be snugly received within the D-shaped opening 80 of the shell 76. Naturally, the blade section 26 of the insulator 16 also projects forward within such D-shaped opening 80 of the shell 76. The shell further includes locating projections 81 for cooperation with the indention 106 of the cover 90, 91 (shown in FIG. 6) described in detail later.

A top shield 82 and a bottom shield 84 are respectively disposed on the top and the bottom of the pre-assembled or semi-finished assembly consisting essentially of the insulator 16, the contacts 22, 24, the wires 46 of the cable 42, the top spacer 48 and the bottom spacer 50. Each shield 82, 84 has a base plate 86 defining a plurality of mounting apertures 87 therein and with two pairs of side abutment walls 88, 89 respectively positioned on the front portion and the rear portion of thereof wherein there is a lateral offset between the front pair of side abutment walls 88 and the rear pair of side abutment walls 89. Therefore, when the top shield 82 and the bottom shield 84 are attached to the top and the bottom of the semi-finished assembly, the front pair of abutment walls of the top shield 82 and those of the bottom shield 84 will be overlapped with each other in a lateral direction; similarly, the rear pair of abutment walls 89 of the top shield 82 and those of the bottom shield 84 will operate with each other in the same manner. Thus, through cooperation of the front pairs of abutment walls 88 of the shields 82, 84 and the rear pairs of abutment walls 89 of the shields 82, 84, the shields 82 and 84 can be secured with each other in an abutment state without lateral and/or lengthwise movement.

Figure 6:
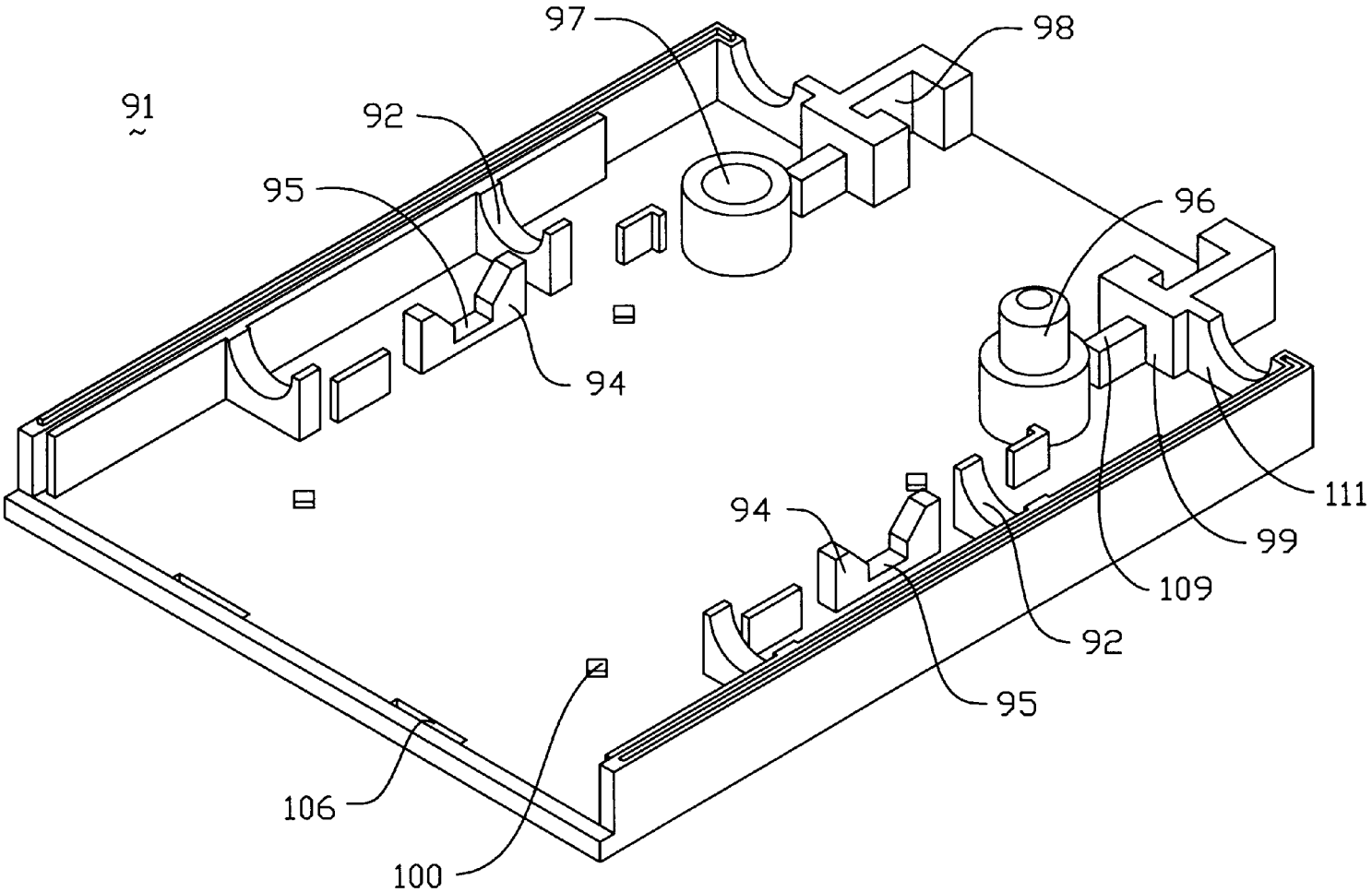
FIG. 6 is an enlarged perspective view of the bottom cover of the cable connector assembly of FIG. 1.

Finally, a top cover 90 and a bottom cover 91 are attached to the aforementioned sub-combination of the final assembly. Referring to FIG. 6, each cover 90, 91 includes a pair of semi-circle channels 92 on two sides for allowing a pair of screws 110 to receivably extend therethrough. A pair of mounting blocks 94 each defining a groove 95 therein for cooperatively receiving the rear mounting ears 36 of the insulator 16 so that the insulator 16 of such sub-combination can be retained within the covers 90, 91 without lengthwise movement. Each cover 90, 91 further includes mounting posts 100 extending inwardly for cooperatively receipt within the corresponding mounting apertures 87 in the shields 82, 84, thereby the sub-combination of the final assembly can be retained within the covers 90, 91 without horizontal movement.

Each cover 90 (91) further includes an alignment post 96 and an alignment receiving cylinder 97 for mutually cooperation with the receiving cylinder 97 and the post 96 of the counterpart cover 91 (90) so that the top cover 90 and the bottom cover 91 can be aligned with each other when assembled. A receiving shroud section 98 is formed on the rear portion of each cover 90, 91 for receiving therein an enlarged head 101 of a strain relief 102 through which the cable 42 extends. A stopper wall 99 is formed in front of the shroud section 98 of each cover 90, 91. A clip 103, includes a ring portion 104 for binding the exit of the cable 42, and a pair of wings 105 for supportably embedded within the recessions 109 adjacent the stopper wall 99 and confront the corresponding stopper walls 99 so as to resist the rearward pull force applied to the external cable, thus functioning as auxiliary strain relief.

The cover 90, 91 further includes retention indention 106 on the interior surface of the front portion for latchably receiving the locating projections 81 of the shell 76, thus resulting in additional retention of the sub-combination of the final assembly with regard to the covers, 90, 91.

After the top cover 90 and the bottom cover 91 precisely and fully enclose the sub-combination of the final assembly, the top cover 90 and the bottom cover 91 can be secured to each other by ultrasonic welding along the edges thereof. Therefore, the whole final assembly is in a hermetic manner. Under this situation, the screws 110 have been installed within the covers 90, 91 and extends out of the screw holes 107 of the shell 76 for being adapted to latchably engage the complementary receptacle connector (not shown), wherein the stopper ring 108 of each screw can rest against the rear wall 111 of the cover 90, 91 for preventing rearward withdrawal of the screw 110 from the cover 90, 91 of the final assembly.

The assembling method and the corresponding structure of the invention is somewhat similar to and can be referred to the copending application Ser. No. 08/748,101 for easy understanding.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

Therefore, person of ordinary skill in this field are to understand that all such equivalent structures are to be included within the scope of the following claims.

We claim:

1. A cable connector assembly comprising:

an insulator defining a plurality of passageways;

a plurality of contacts received within the corresponding passageways, each of said contacts including an IDC termination section;

a cable enclosing a plurality of wires wherein each of said wires connected to the termination section of the corresponding contact;

at least a spacer provided on one surface of the insulator, defining a cavity and a plurality of troughs adjacent to the cavity for respective receipt of the corresponding wires; and a shunting bus including a base plate retainably received within the cavity of the spacer, and a plurality of lances integrally extending from the base plate; wherein some of said lances are removed from the base plate, and remaining lances pierce into some of the selective corresponding wires thereby achieving short-circuiting function thereof.

2. The assembly as defined in claim 1, wherein a housing is attached to a front portion of the insulator, and a shell is further attached to the front portion of the insulator for sandwiching the housing therebetween.

3. The assembly as defined in claim 1, wherein said spacer further defines at least a mounting opening for cooperation with a mounting post extending upward from the cavity of the insulator for retainably receiving said shunting bar therein.

4. The assembly as defined in claim 3, wherein at least a shield is positioned to cover the spacer.

5. The assembly as defined in claim 4, wherein at least a cover is positioned to cover the shield.

6. The assembly as defined in claim 5, wherein said cover includes at least a mounting block for latchably engagement with a mounting ear of the insulator.

7. The assembly as defined in claim 6, wherein said cover providing a stopper wall, and a clip, which binds the wires and is positioned at an exit of the cable, confronts said stopper wall.

8. A method for shorting circuit in a cable connector assembly, the steps comprising:

providing said connector assembly with a cable enclosing a plurality of wires;

providing a plurality of contacts each having an IDC termination section;

mechanically and electrically engaging each wire with the IDC termination of the contact; and providing a shunting bar with a plurality of integrally formed piercing lances for mechanical and electrical engagement with the selective wires in an IDC interconnection manner, respectively wherein some of the designated contacts are short-circuiting with the selective wires through such piercing lances of the shunting bar.

9. A cable connector assembly comprising:

an insulator with a plurality of contacts thereon;

each of said contacts including an IDC termination section at a rear portion thereof;

a plurality of wires mechanically and electrically engaged with the termination sections of the contacts, respectively;

at least a spacer provided on one surface of the insulator, defining a cavity and a plurality of troughs adjacent to the cavity for respective receipt of the corresponding wires; and a shunting bar defining a base plate retainably received within the cavity of the spacer, and a plurality of detachable lances extending from the base plate wherein the detachable lances selectively pierce into some of the designated corresponding wires thereby offering some of the contacts with shorting-circuit thereof.

10. The assembly as defined in claim 9, wherein some of the lances are detached from the base plate of said shunting bar for not mechanical and electrical engagement with the wires, and the remaining lances which are not detached therefrom, are capable of piercing into the designated wires.

* * * * *